US006261135B1

(12) United States Patent
Shinchi

(10) Patent No.: US 6,261,135 B1
(45) **Date of Patent: *Jul. 17, 2001**

(54) CONNECTION STRUCTURE FOR CONNECTING A COVERED WIRE AND TERMINAL AND A CONNECTION METHOD THEREOF

(75) Inventor: Akira Shinchi, Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,509

(22) Filed: Jan. 8, 1998

(30) Foreign Application Priority Data

Jan. 9, 1997 (JP) ..... 9-002328

(51) Int. Cl.[7] ..... H01R 4/02
(52) U.S. Cl. ..... 439/874; 439/700
(58) Field of Search ..... 439/736, 874, 439/397, 400, 875, 876, 884, 883

(56) References Cited

U.S. PATENT DOCUMENTS 4,648,679 * 3/1987 Pelczarski ..... 339/99 R
5,759,052 * 6/1998 Seki ..... 439/189
5,849,424 * 12/1998 Sugawara et al. ..... 428/674

FOREIGN PATENT DOCUMENTS 7-70345 7/1995 (JP) .

* cited by examiner

*Primary Examiner*—P. Bradley
*Assistant Examiner*—Truc Nguyen
(74) *Attorney, Agent, or Firm*—Finnegan, Henderson, Farabow, Garrett & Dunner, L.L.P.

(57) ABSTRACT

A connection structure for connecting a covered wire and terminal includes a first member having groove portion, a terminal to be incorporated in the groove portion, a covered wire to be placed on the terminal; and a second member having a convex portion for clogging the groove portion, wherein, while pressing the covered wire by the second member, ultrasonic vibration is applied thereto so as to melt a cover portion of the covered wire thereby placing the covered wire and core elements of the covered wire into conductive contact with each other, the terminal having a wire connecting portion including a bottom wall on which the covered wire is to be placed and vertical walls raised from side edges of the bottom wall, the vertical wall having a gap relative to the convex portion.

6 Claims, 5 Drawing Sheets

CONNECTION STRUCTURE FOR CONNECTING A COVERED WIRE AND TERMINAL AND A CONNECTION METHOD THEREOF

BACKGROUND OF THE INVENTION

1. Field of the Invention

This invention relates to a connection structure for connecting a covered wire and a terminal, wherein a covered wire is placed on a terminal and a cover portion thereof is melted and removed by pressing and applying ultrasonic vibration, so that the core elements of the covered wire and in terminal are conductive contact with each other, and a connection method thereof.

2. Description of Relevant Art

This kind of art has been disclosed in, for example, Japanese Patent Publication No.7-70345. FIGS. 1 show that invention. FIG. 1A shows a first member 1 and a second member 2. The members 1, 2 are made of material (plastic) which can be fused by ultrasonic vibration. The first member 1 contains groove portions 3, and the second member 2 has convex portions 4 which engage the groove portions 3.

FIGS. 1B, 1C show a state in which a terminal 7 is contained in the groove portion 3 and a covered wire 8 is placed thereon. On a bottom face of the groove portion 3 are provided small concave portions 3*a* and a top face of a convex portion 4 has small protrusions 4*a* which engage the small concave portions 3*a*.

According to this art, as shown in FIGS. 1B, 1C, the terminal 7 is incorporated in the groove portion 3 and a covered wire 8 is placed thereon. The second member 2 is placed on the top face of the first member 1 so that the protrusions 4 are inserted into the groove portions 3. While applying a pressing force between the first and second members 1, 2, ultrasonic vibration is applied so as to melt the cover portion of the covered wire 8 nipped between the protrusion 4 and the groove portion 3. Consequently, the core elements of the covered wire 8 and terminal 7 come into conductive contact contact with each other. At the same time, the first and second members 1, 2 are fit to each other by fusion so as to obtain an integrated connection structure as shown in FIG. 1D.

However, according to the aforementioned prior art, and as shown in FIG. 2, the core elements 8*a* retreat together with the melted cover portion 8*b* into a gap provided between the groove portion 3 and a side face of the protrusion 4, so that sometimes, it is not possible obtain excellent conductive contact between the core elements 8*a* and the terminal 7.

As a countermeasure for solving that problem, a method of eliminating a gap between the groove portion 3 and the side face of the protrusion 4 as shown in FIG. 3 can be considered. However, if the groove portion 3 and the side face of the protrusion 4 are in contact with each other, ultrasonic wave is not transmitted properly to target positions (covered wire 8 on the terminal 3) so that processing efficiency deteriorates. Further, because escape of the melted cover portion 8*b* is limited to the length direction of the groove portion 3, the engagement between the first and second members 1, 2 becomes incomplete, so that there is a fear that excellent conductive contact between the core elements 8*a* and terminal 7 cannot be obtained.

SUMMARY OF THE INVENTION

The present invention has been achieved with such points in view.

It therefore is an object of the invention to provide a connection structure for connecting a covered wire and terminal, in order to obtain an excellent conductive contact between core elements of the covered and of the terminal without deterioration processing efficiency, and a connection method thereof.

To achieve the object, a first aspect of the invention provides a connection structure for connecting a covered wire and terminal comprising, a first member having groove portion; a terminal to be incorporated in the groove portion, a covered wire to be placed on the terminal, and a second member having a convex portion for clogging the groove portion, wherein, while pressing the covered wire by the second member, ultrasonic vibration is applied thereto so as to melt a cover portion of the covered wire thereby making the covered wire and core elements into conductive contact with each other, the terminal having a wire connecting portion comprising a bottom wall on which the covered wire is to be placed and vertical walls raised from side edges of the bottom wall, the vertical wall having a gap relative to the convex portion.

According to the first aspect, even in a case when the core elements of the covered wire move to the gap between the groove portion and convex portion together with the melted cover portion, the core elements make contact with the vertical walls of the terminal. Further, because there is a gap secured between the vertical wall and the convex portion, ultrasonic wave can be transmitted excellently to a target position and the melted cover portion can be allowed to escape into that gap, thereby placing the core elements and terminal into a secure contact with each other.

Accordingly, an excellent conductive contact performance can be obtained.

To achieve the object, a second aspect of the invention provides a connection structure for connecting a covered wire and terminal according to the first aspect wherein the first member is a terminal holding portion formed so as to protrude at an end of a connector housing body and the second member is a cover body for clogging the terminal holding portion.

According to the second aspect, the covered wire and terminal come into contact with each other by ultrasonic vibration and simultaneously an integrated connector can be formed.

To achieve the object, a third aspect of the invention provides a connection structure for connecting a covered wire and terminal according to the first or second aspect wherein a gap for allowing an escape of the melted cover portion of the covered wire is formed between a front end of the vertical wall and a root portion of the convex portion of the second member.

According to the third aspect, the melted cover portion escapes into a gap secured between a front end of the vertical wall of the terminal and a root portion of the convex portion of the second member.

Accordingly, there is produced such an effect that secure conductive contact between the core elements and terminal can be attained.

To achieve the object, a fourth aspect of the invention provides a connection structure for connecting a covered wire and terminal according to any one of the first - third aspect wherein the wire connecting portion has a U-shaped cross section having a pair of vertical walls facing each other.

According to the fourth aspect, because a pair of the vertical wall are provided, even when the core elements escape to both sides of the convex portion, the core elements can be brought into contact with the terminal securely.

To achieve the object, a fifth aspect of the invention provides a connection structure for connecting a covered wire and terminal according to any one of the first—third aspect wherein the wire connecting portion has a L-shaped cross section having a vertical wall on only one side thereof.

According to the fifth aspect, the vertical wall is provided on only one side, and therefore the shape of the terminal is simple and easy to produce.

BRIEF DESCRIPTION OF THE DRAWINGS

The above and further objects and novel features of the present invention will more fully appear from the following detailed description when the same is read in conjunction with the accompanying drawings, in which:

FIGS. 1A, 1B, 1C, 1D explain a prior art, while FIG. 1A is a perspective view showing structures of a first and second members, FIG. 1B is a longitudinal sectional view showing a state in which a terminal and covered wire are incorporated in a groove portion of the first member, FIG. 1C is a front view showing the same state and FIG. 1D is a longitudinal sectional view showing a state in which the connection is completed;

FIGS. 4A, 4B are explanatory views of an embodiment of the present invention while FIG. 4A is a sectional view of a connection portion between a wire and terminal and FIG. 4B is a perspective view showing a structure of the terminal;

FIGS. 6A, 6B are explanatory views of another embodiment of the present invention while FIG. 6A is a sectional view of a connection portion between a wire and terminal and FIG. 6B is a perspective view showing a structure of a terminal.

DETAILED DESCRIPTION OF THE PREFERRED EMBODIMENTS

Figure 1A:
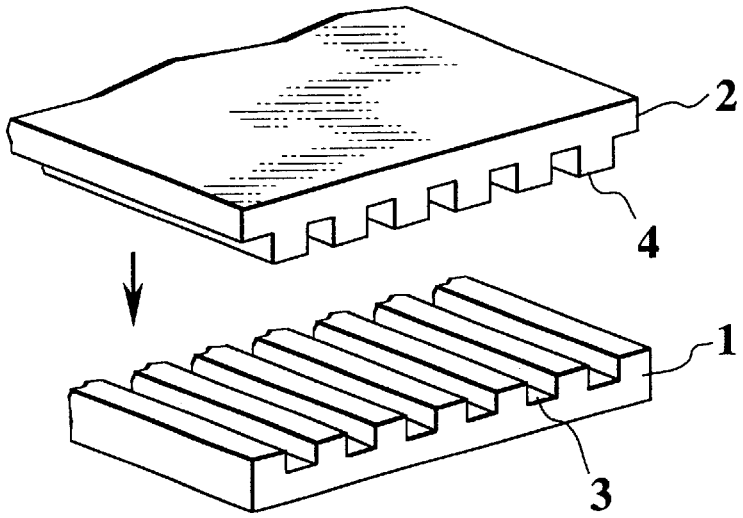
FIG.1A PRIOR ART
Figure 1B:
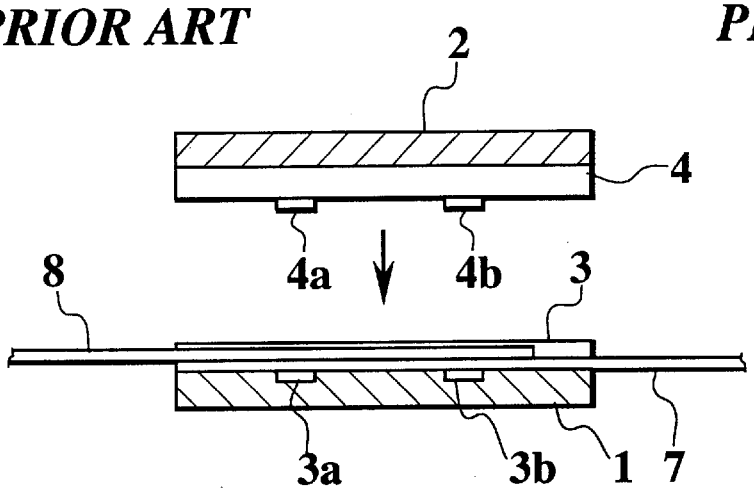
FIG.1B PRIOR ART
Figure 1C:
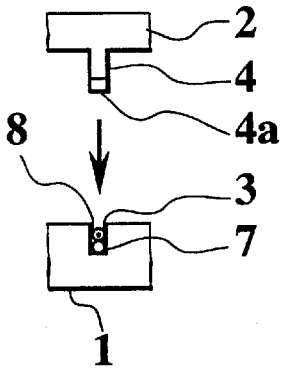
FIG.1C PRIOR ART
Figure 1D:
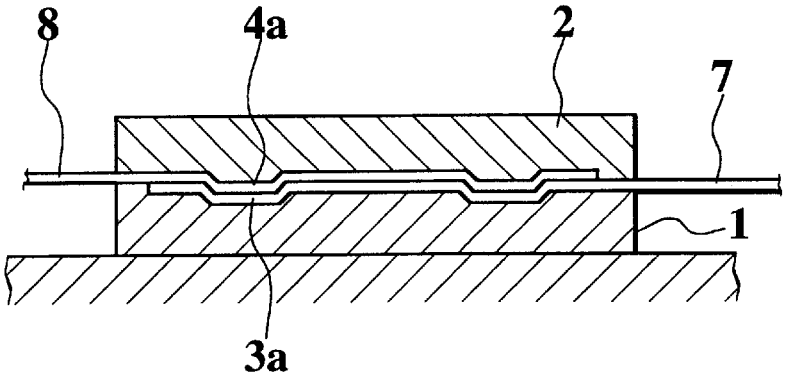
FIG.1D PRIOR ART
Figure 2:
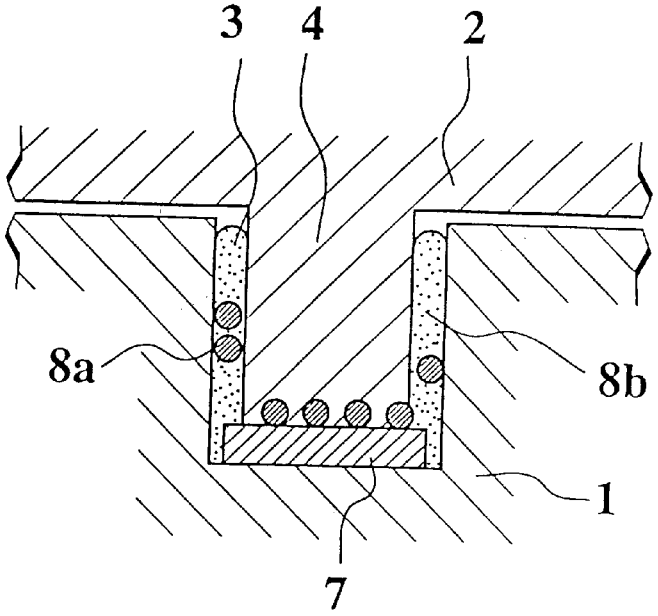
FIG.2 PRIOR ART
FIG. 2 is a sectional view of a connection portion for use in description of a problem of the prior art.
Figure 3:
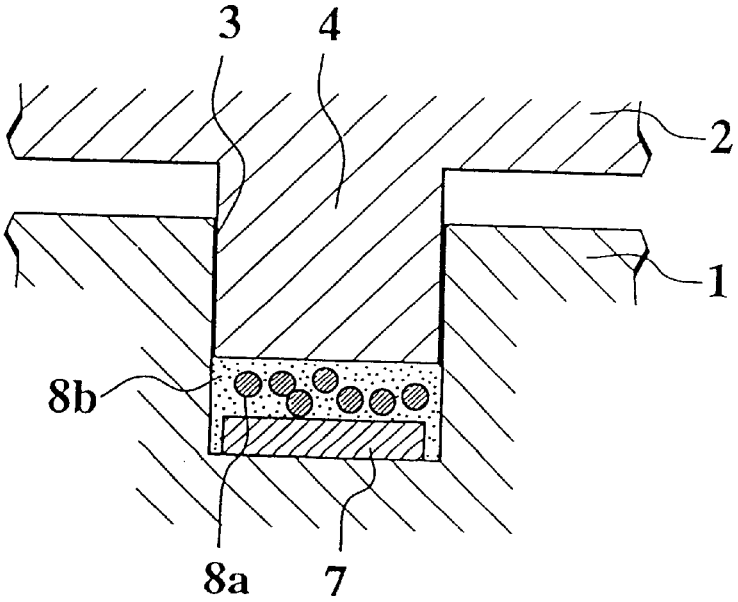
FIG. 3 is a sectional view of a connection portion for use in description of a problem of the prior art.

The contents of U.S. Pat. No. 5,584,122 are incorporated herein by reference.

There will be detailed below the preferred embodiments of the present invention with reference to the accompanying drawings. Like members are designated by like reference characters.

Figure 4A:
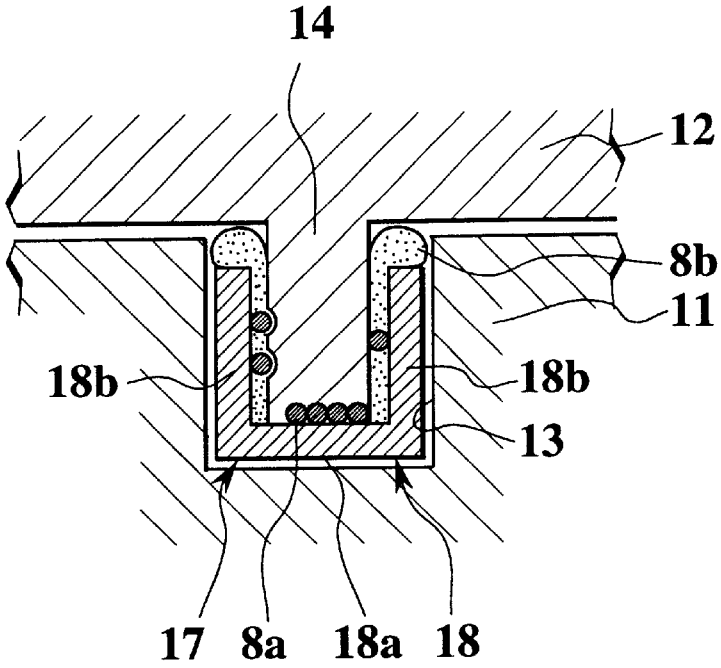
Figure 4B:
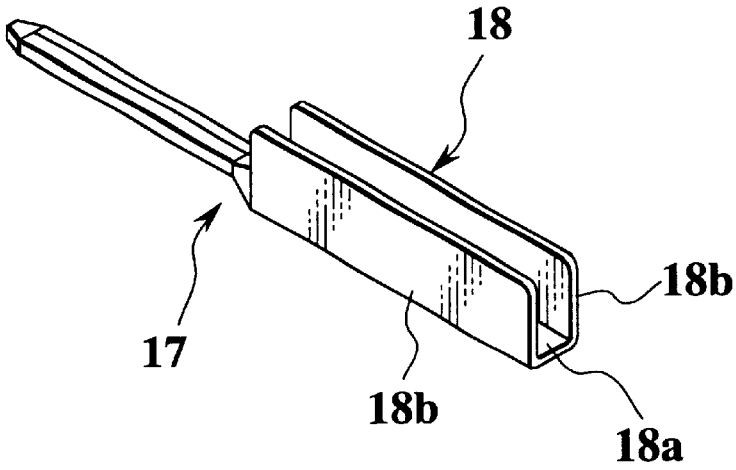
Figure 5:
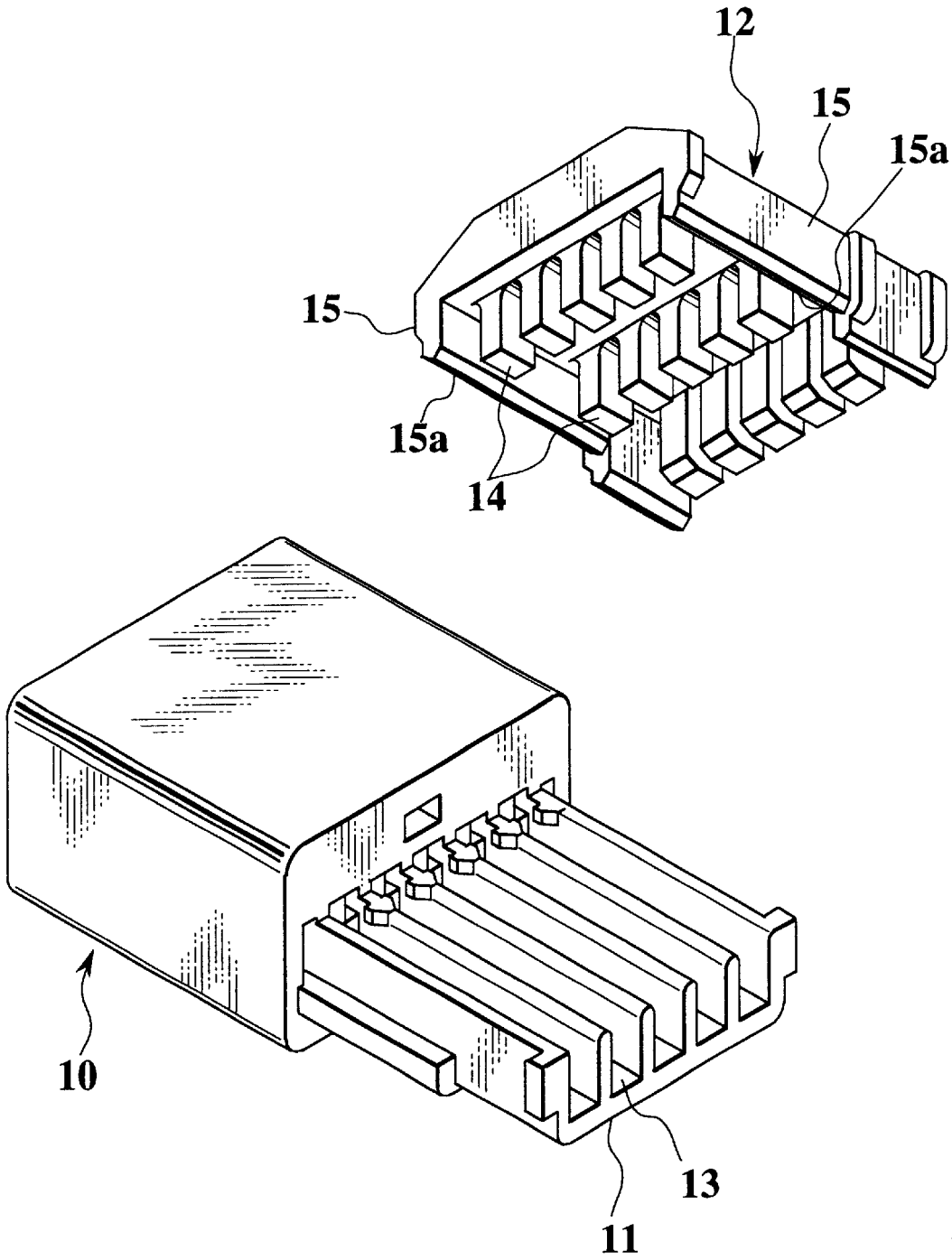
FIG. 5 is a perspective view of a connector housing body (first member) and a cover body (second member) according to the embodiment of the present invention.

FIGS. 4A, 4B are explanatory diagrams for explaining a connection structure and method according to the present embodiment, of the invention while FIG. 4A is a sectional view of a connection portion and FIG. 4B is a perspective view of a structure of a terminal 17. FIG. 5 shows a connector housing body 10 which is a first member and a cover body 12 which is a second member.

Referring to FIG. 5, a terminal holding portion 11 is disposed so as to protrude at a rear end portion of the connector housing body 10. Actually, this portion corresponds to the first member. The terminal holding portion 11 includes a plurality of groove portions 13 which are arranged in parallel to each other. The cover body 12 has a plurality of convex portions 14 which engage the groove portions 13. The connector housing body 10 and cover body 12 are formed of resin which can be fused to one another by ultrasonic vibration. A front end portion 15*a* of the width-direction both-side wall 15 of the cover body 12 is pointed so as to be fused by ultrasonic vibration when it is fit to the terminal holding portion 11.

As shown in FIG. 4B, at a rear end of the terminal 17 is formed a wire connecting portion 18 comprising a bottom wall 18*a* on which a covered wire 8 is to be mounted and a pair of right and left vertical walls 18*b*, 18*b* raised from both edges of the bottom wall 18*a*, the wire connecting portion 18 having a U-shaped cross section. The distance between the pair of the vertical walls 18*b*, 18*b* is designed so as to secure a predetermined gap with respect to a side face of the convex portion 14 when the convex portion 14 of the cover body 12 is inserted therein.

To obtain a connection structure between the covered wire 8 and the terminal 17, as shown in FIG. 4A, the wire connecting portion 18 of the terminal 17 is incorporated in the groove portion 13 provided in the terminal holding portion 11 of the connector housing body 10, and the covered wire 8 is placed on the bottom wall 18*a* of the wire connecting portion 18 of the terminal 17.

Then, the cover body 12 is mounted thereon, so that each of the convex portions 14 of the cover body 12 is inserted in between the vertical walls 18*b*, 18*b* of the wire connecting portion 18 of the terminal 17 disposed in each of the groove portions 13 of the terminal holding portion 11. In this condition, there is a predetermined gap secured between the vertical wall 18*b* and a side face of the convex portion 14. That gap is continuous with another gap secured between the top of the vertical wall 18*b* and a root portion of the convex portion 14 (the portion of the second body 12 adjacent to the convex portion 14). Further, there is an appropriate gap secured between the cover body 12 and the terminal holding portion 11 (e.g., between a top face of the terminal holding portion 11 and a bottom face of the cover body 12) so as to prevent both members except the front end portion 15*a* of the width-direction both-side wall 15 of the cover body 12 from making contact with each other.

With this condition, ultrasonic vibration is applied with the cover body 12 being pressed from up by a ultrasonic vibration horn (applying vertical vibration). Consequently, ultrasonic vibration energy is concentrated on the convex portion 14 which nips the covered wire 8 with a bottom face of the groove portion 13. Thus, cover portion 8*b* of the covered wire 8 is melted so that core elements 8*a* of the covered wire 8 are exposed. By pressing of the convex portion 14, the melted cover portion 8*b* is removed so that the core elements 8*a* are conductively contacted with the bottom wall 18*a*.

The core elements 8*a* turned to the vertical wall 18*b* together with the melted cover portion 8*b* make contact with the vertical wall 18*b* so as to be conductive with the terminal 17. At this time, the melted cover portion 8*b* runs away from a gap between the vertical wall 18*b* and the convex portion 14. Consequently, the core elements 8*a* are securely contacted with the terminal 17 so that a connection structure having an excellent conductivity is obtained. Because the connector housing body 10 and the cover body 12 are used as the first and second members respectively, a single connector is produced at the same time when the covered wire 8 is connected to the terminal 17.

Figure 6A:
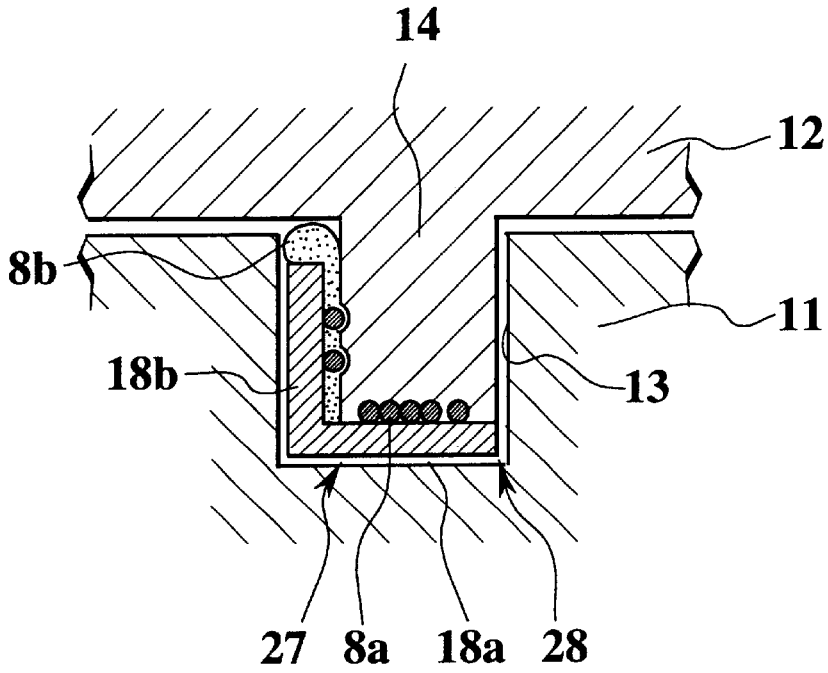
Figure 6B:
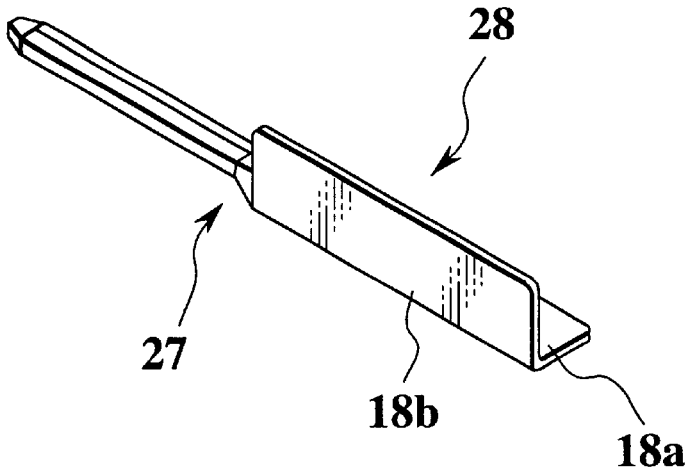

Although a case in which the wire connecting portion 18 of the terminal 17 is formed in U-letter sectional shape has been shown in the above embodiment, the wire connecting portion 28 may use a terminal 27 having only one side vertical wall 18*b* and having a L-shaped cross section, as shown in FIGS. 6A, 6B. In this case, because the vertical wall 18*b* is capable of achieving conductivity with the core elements 8*a* turned to the side thereof, conductive performance can be improved. Further, because the vertical wall 18*b* is provided on only one side in this case, the structure of the terminal 27 is simplified, thereby facilitating production thereof.

While preferred embodiments of the present invention have been described using specific terms, such description is for illustrative purposes, and it is to be understood that changes and variations may be made without departing from the spirit or scope of the following claims.

What is claimed is:

1. A connection structure comprising:

a first member having a groove portion;

a second member having a convex portion for clogging said groove portion of said first member;

a terminal to be accommodated in said grove portion of said first member, said terminal having a wire connecting portion comprising a bottom wall and at least one vertical wall raised from a side edge of said bottom wall; and a covered wire to be placed on said bottom wall of said wire connecting portion of said terminal;

wherein said terminal is accommodated in said groove portion of said first member and said convex portion of said second member is inserted into said groove portion of said first member while defining a gap between said vertical wall of said terminal and a side face of said convex portion of said second member; and wherein, while pressing said covered wire on said bottom wall of said wire connecting portion of said terminal with said convex portion of said second member, ultrasonic vibration is applied thereto so as to melt a cover portion of said covered wire thereby placing core elements of said covered wire and said wire connecting portion of said terminal into conductive contact with each other.

2. The connection structure according to claim 1 wherein said first member is a terminal holding portion formed so as to protrude at an end of a connector housing body and said send member is a cover body for clogging said holding portion.

3. The connection structure according to claim 1 or 2, wherein another gap for allowing an escape of said melted cover portion is formed above a top of said vertical wall, adjacent to a proximal end of said convex portion of said second member, and below a portion of said second member adjacent to said convex portion.

4. The connection structure according to claim 1, wherein said wire connecting portion has a U-shaped cross section formed by a pair of vertical walls facing each other.

5. The connection structure according to claim 1, wherein said wire connecting portion has a L-shaped cross section formed by a vertical wall on only one side thereof.

6. A connection method comprising the steps of:

providing a first member having a groove portion;

providing a second member having a convex portion for clogging said groove portion of said first member;

providing a terminal having a wire connecting portion comprising a bottom wall and at least one vertical wall raised from a side edge of said bottom wall;

accommodating said terminal in said groove portion of said first member;

placing a covered wire on said bottom wall of said terminal;

inserting said convex portion of said second member into an interior of said vertical wall while defining a gap between said vertical wall of said terminal and a side face of said convex portion of said second member; and pressing said covered wire on said bottom wall of said wire connecting portion of said terminal with said convex portion of said second member and simultaneously applying ultrasonic vibration thereto so as to melt a cover portion of said covered wire thereby placing core elements of said covered wire and said wire connecting portion of said terminal into conductive contact with each other.

* * * * *